United States Patent [19]

Hromas et al.

[11] Patent Number: 4,907,655

[45] Date of Patent: Mar. 13, 1990

[54] PRESSURE-CONTROLLED WELL TESTER OPERATED BY ONE OR MORE SELECTED ACTUATING PRESSURES

[75] Inventor: Joe C. Hromas; Laurent E. Muller, both of Sugar Land, Tex.

[73] Assignee: Schlumberger Technology Corporation, Houston, Tex.

[21] Appl. No.: 178,091

[22] Filed: Apr. 6, 1988

[51] Int. Cl.[4] ..... E21B 34/10

[52] U.S. Cl. ..... 166/321; 166/317; 166/324; 166/332

[58] Field of Search ..... 166/321, 319, 324, 332, 166/151, 183, 184, 185, 188, 317

[56] References Cited

U.S. PATENT DOCUMENTS

| | | | |
|---|---|---|---|
| Re. 29,638 | 5/1978 | Nutter | 166/128 X |
| 3,856,085 | 12/1974 | Holden et al. | 166/324 X |
| 3,860,069 | 1/1975 | Wray et al. | 166/321 X |
| 3,901,314 | 8/1975 | Nutter | 166/321 X |
| 3,964,544 | 6/1976 | Farley et al. | 166/321 X |
| 3,976,136 | 8/1976 | Farley et al. | 166/264 |
| 4,105,075 | 8/1978 | Helmus | 166/321 |
| 4,134,454 | 1/1979 | Taylor | 166/324 X |
| 4,361,188 | 11/1982 | Russell | 166/321 X |
| 4,440,230 | 4/1984 | McGill | 166/321 |
| 4,617,999 | 10/1986 | Beck | 166/321 X |

*Primary Examiner*—Hoang C. Dang

*Attorney, Agent, or Firm*—Henry N. Garrana; John H. Bouchard

[57] ABSTRACT

In the representative embodiment of the new and improved well bore apparatus disclosed herein, a test valve is arranged to be coupled in a pipe string for positioning in a well bore. When the test valve is arranged to be selectively operated by changes in the well annulus pressure, the apparatus of the present invention includes a first normally-open pressure reference valve that may be operated to trap well annulus pressure in a chamber on the tool body to provide a reference pressure that permits the operation of the pressure-controlled test valve. The apparatus of the invention may include a second normally-open valve which is coupled to the first valve and is operated for controlling communication through a bypass passage between the interior and exterior of the tool body. An annulus pressure-responsive actuator piston coupled to the first and second valves is operated by opening a rupture disc to communicate the well annulus pressure to the actuator piston. A relief valve is included in the apparatus and arranged to prevent development of excessive squeeze or suction pressures below the packer by being opened when the fluid pressure in the tool body is less than the well annulus pressure by at least a first predetermined differential or when the fluid pressure in the tool body is greater than the well annulus pressure by at least a second predetermined differential.

33 Claims, 3 Drawing Sheets

PRESSURE-CONTROLLED WELL TESTER OPERATED BY ONE OR MORE SELECTED ACTUATING PRESSURES

BACKGROUND OF THE INVENTION

This invention relates to full-bore drillstem testing apparatus; and, more particularly, this invention pertains to new and improved drillstem testing apparatus which is operated by selectively varying the pressure of the well bore fluids without needlessly risking damage to perforated well bore intervals.

BACKGROUND ART

It is customary to conduct so-called "drillstem tests'-'in cased well bores having one or more perforated intervals that provide fluid communication with earth formations penetrated by the well bore. One typical operating technique utilizes a fullbore packer that is positioned at a convenient depth location in the well bore and set for packing-off or isolating the formations which are to be tested from the completion fluids in the well bore. To conduct these drillstem tests, an assembly of tandemly-coupled full-bore tools is dependently suspended from a pipe string that is successively assembled and lowered into the cased well bore until a depending conduit or seal assembly arranged on the lower end of the tool string is inserted into a central seal bore in the packer and fluidly sealed therein. A normally-closed valve in the tool string is then selectively operated for opening fluid communication between the pipe string and the formations below the packer. In this manner, should the formations contain producible connate fluids, opening of the test valve will allow the fluids to flow to the surface by way of the tool string and the supporting pipe string. A series of pressure measurements are typically obtained by means of suitable pressure recorders included in the tool string. A sample-collecting tool is also typically included in the tool string whenever it is desired to collect one or more representative samples of the connate fluids produced during the testing operations.

Those skilled in the art recognize, of course, that many of the testing tools employed over the past few years have been controlled by selectively increasing the pressure of the well control fluids in the well bore above the packer to open the test valve and relieving the increased pressure when the valve is to be closed. Typical testing tools of this nature are described in Reissue Patent 29,638 and U.S. Pat. No. 3,901,314 issued to Nutter as well as in U.S. Pat. No. 4,440,230 issued to McGill, each of which are respectively assigned to the assignee of the present application and are hereby incorporated by reference. As fully described in these patents, these tools are operated by a pressure-responsive valve actuator having one pressure surface subjected to the pressure of the well bore fluids and its other pressure surface subjected to the pressure of a compressible gas such as nitrogen that is isolated in one portion of an enclosed chamber by a floating piston member. These tools respectively include inner and outer telescoping members that are arranged for controlling the communication between the well bore and the other portion of the enclosed chamber. In each of these tools, these telescoping members are initially positioned to communicate the well bore fluids with the other portion of the enclosed chamber so that the valve actuator will remain balanced in relation to the hydrostatic pressure of the well control fluids as the tools are being lowered into a well bore. Once these testing tools are positioned to conduct a test, the supporting pipe string is then slacked off to shift these inner and outer telescoped members to an alternate position which selectively closes off communication with the well bore and traps the well fluids in the other portion of the enclosed chamber and thereby maintain the compressible gas at the hydrostatic pressure of the well fluids. Since the other side of the valve actuator is still communicated with the well bore fluids, the test valve in each of these tools can thereafter be selectively opened and closed by selectively increasing and relieving the pressure of these fluids.

The test tool described in the above-identified Nutter reissue patent utilizes an actuator spring which is cooperatively arranged to reclose the test valve whenever the pressure in the well bore is again restored to its normal hydrostatic pressure. Nevertheless, it has been noted that the actuator spring in the Nutter testing tool lacked sufficient strength to reliably return the valve actuator to its normal valve-closing position in some operating situations. Accordingly, the new and improved testing tool shown in the above-identified McGill patent is arranged in keeping with the above-described inventive concepts of the Nutter reissue patent; but, as shown generally at "70" in this McGill patent, the McGill tester valve includes an additional pressure-responsive actuator which cooperatively utilizes the elevated pressure of the well bore fluids to supplement the closing force provided by the actuator spring.

The above-identified Nutter patent also shows a testing tool that also incorporates the inventive concepts of the Nutter reissue patent. As fully described in that patent, this later testing tool is uniquely modified to include an enclosed chamber that is normally closed by a rupture disc cooperatively arranged to fail if the pressure of the well bore fluids is inadvertently raised to an excessive level. Should the rupture disc fail, well bore fluids are admitted into a normally-isolated chamber in the test tool to impose an additional closing force on the valve actuator. Once the rupture disc fails, the valve member is permanently moved to its closed position and the testing tool must be returned to the surface before the valve member can be reopened.

When either of the above-described testing tools are utilized with a full-bore production packer that has been set in the well bore above a formation interval of interest, typically a slip joint is coupled to the lower end of the supporting pipe string above one or more drill collars for imposing a substantial downward force on the tool string to prevent a seal assembly that carries a perforated tail pipe on its lower end from being forced upwardly out of the packer as treating fluids are injected into the isolated well bore interval. It will, of course, be realized that when a test operation is conducted in a well bore that has a permanent packer, it is preferred to avoid having either a slip joint or one or more drill collars coupled in the pipe string.

It will be realized that when tests are conducted in a well bore which has a permanent packer set above a perforated interval, the isolated formations might be damaged unless the pressure in that interval is controlled. For instance, a bypass vent passage should be provided at a convenient place in the tool string to accommodate the fluids displaced from the isolated interval as the seal assembly is inserted into the packer seal bore. If the formations are to be protected, the passage must be closed before increasing the pressure in the well bore annulus above the packer to open the test valve. Conversely, it will be recognized that once the seal assembly has been inserted into the packer seal bore, the pipe string is then typically elevated to properly position the test string before commencing a test. Thus, unless a bypass vent or relief passage is provided, the raising of the seal assembly in relation to the packer seal bore may reduce the pressure of the fluids in the isolated interval to an unacceptably-low level.

OBJECTS OF THE INVENTION

Accordingly, it is an object of the present invention to provide a new and improved drillstem testing tool which may be selectively operated from the surface without having to manipulate the supporting pipe string for trapping well bore fluids in a portionof an enclosed pressure reference chamber to provide an elevated pressure therein that can enhance the valve actuation of the tool.

It is a further object of the invention to provide a new and improved testing tool including a pressure-responsive relief valve which cooperatively responds to changes in the pressure differential between the interior and exterior of the pipe string for protecting the earth formations to be tested from adverse high or low pressures.

SUMMARY OF THE INVENTION

These and other objects of the present invention are attained by providing a pressure-actuated testing tool arranged to be connected in a pipe string and including a body defining a flow passage. Tester valve means, which may be full-opening, are cooperatively arranged in the tool body for selectively opening fluid communication through the flow passage in response to a selected increase in the well annulus pressure. An enclosed chamber is arranged in the body and is divided by a floating compensating piston into a first portion for containing a compressible fluid and a second portion adapted to contain well bore fluids that will act on the piston to maintain the compressible fluid at an elevated pressure corresponding to the pressure of the well annulus fluids in the second portion of the chamber. The testing tool further includes pressure-responsive valve means normally admitting well bore fluids into the second portion of the chamber and operable when the well annulus pressure increases to a selected level above atmospheric pressure for then closing to trap a supply of the well bore fluids at this increased pressure in the second chamber portion. The increased pressure provides a reference pressure to permit opening the test valve means in response to a further increase in annulus fluid pressure. When such further increased pressure is reduced, a mechanical coil spring that was compressed during valve opening forces the test valve means back to the closed position. Except for the feature of having a pressure-responsive reference valve, the foregoing summary is of equipment disclosed in the above-mentioned Nutter Re No. 29,638 patent and the McGill No. 4,440,230 patent, to which reference has been made.

Although pressure-responsive reference valves are know generally (see U.S. Pat. Nos. 3,976,136, 3,964,544, and 4,105,075) such prior valve structures have required a differential in pressure between annulus fluids and tubing fluids in order to produce a reference valve closing force. This requirement is highly undesirable for the principle reason that subsequent well service operations such as fracturing, acidizing or squeezing can employ such high tubing pressures as to cause the test valve to automatically close, and thus abruptly terminate the particular well service operation being performed. In accordance with the present invention, however, reference valve operation is totally insensitive to internal or tubing pressure and thus is a marked advance and improvement over the structures shown in the patents noted in the above parenthetical. The testing tool further includes bypass relief valve means initially controlling fluid communication between the well bore and the flow passage in the tool so that the isolated well bore interval is not subjected to unacceptable pressure differentials while the testing tool is being initially positioned before starting the testing operation.

BRIEF DESCRIPTION OF THE DRAWINGS

The several patentable features and distinctive aspects of the present invention are set forth with particularity in the appended claims. The arrangement and operation of the invention, together with further objects and various advantages thereof, may best be understood by way of the following written description of a preferred embodiment of apparatus incorporating the principles of the invention when taken in conjunction with the accompanying drawings, in which:

DESCRIPTION OF A PREFERRED EMBODIMENT

Figure 1:
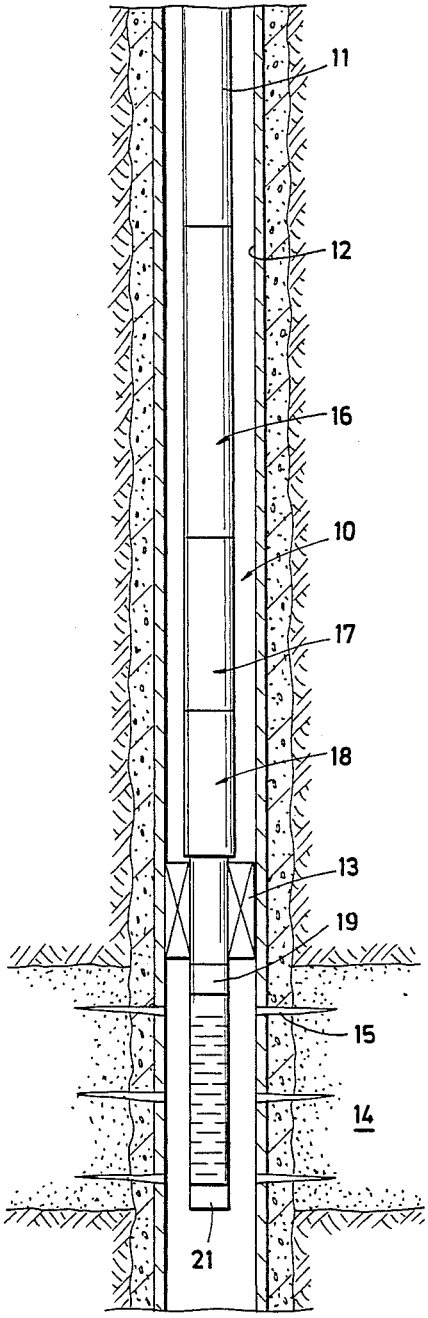
FIG. 1 shows a string of full-bore well tools such as may be typically used in a cased well bore and including a full-bore testing tool of the present invention.

Turning now to FIG. 1, a testing tool 10 arranged in accordance with the principles of the present invention is shown dependently coupled from the lower end of a pipe string 11 such as is typically assembled from a plurality of tandemly-coupled tubing joints. Although the new and improved testing tool 10 can be successfully employed to conduct drillstem tests in an uncased borehole, the testing tool is depicted as it might be utilized to conduct a drillstem test in a cased well bore as at 12. It will also be realized that although the new and improved testing tool 10 can be operated in conjunction with a retrievable packer that is tandemly coupled to the lower end of the testing tool, FIG. 1 shows a production packer 13 that has been previously set at a convenient location in the well bore 12 for isolating one or more earth formations, as at 14, which are in communication with the isolated well bore interval by means of one or more perforations as at 15.

The testing tool 10 includes a pressure-operated tester valve 16 such as described in the above-identified McGill patent that is operated from the surface by selectively controlling the pressure of the fluids in the annulus of the well bore 12 above the packer 13. The drillstem testing tool 10 further includes a new and improved pressure reference tool 17 and a double-acting bypass valve 18 that are respectively arranged in accordance with the principles of the present invention. As will be subsequently described, the pressure reference tool 17 and bypass valve 18 are coupled in the tool string below the tester valve 16 and arranged to facilitate the operation of the testing tool to conduct one or more drillstem tests in the well bore 12. A seal assembly or so-called "stinger", as shown at 19, that is appropriately sized to be slidably and sealingly inserted into the upstanding seal bore of the packer 13 is tandemly coupled in the string of tools at a convenient location below the bypass valve 18.

To record the changes in pressure conditions in the well bore 12 during the course of a drillstem test, the testing tool 10 further includes one or more pressure recorders (not seen in the drawings) which are enclosed in a housing 21 arranged at a convenient location in the string of testing tools. It will, of course, depend upon the nature of any given testing operation and the condition of the well bore 12, but those skilled in the art will appreciate that one or more additional full-bore tools such as a sample collector, a jar and a safety joint (none of which are illustrated) may also be included in the tool string without affecting the operation of the drillstem testing tool 10. It will also be appreciated that, if necessary, a pressure-actuated perforating gun or so-called "tubing-conveyed perforator" (not seen in the drawings) such as the one described in U.S. Pat. No. 4,509,604 can be dependently coupled below the seal assembly 19 and appropriately arranged to be operated after the testing tool 10 has been positioned in the well bore 12.

Turning now to FIGS. 2A–2D, successive, partially cross-sectioned elevational views are shown for illustrating a preferred embodiment of the new and improved testing tool 10 of the present invention which (as previously described by reference to FIG. 1) is arranged for operation in a cased well bore, as at 12, that was previously perforated to communicate one or more formations, as at 14, with the isolated interval of the well bore below the packer 13. To facilitate the description of the tool 10, FIGS. 2A–2D have been simplified by eliminating some of the minor constructional details of the tool but without affecting the full and complete disclosure of the present invention.

Figure 2A:
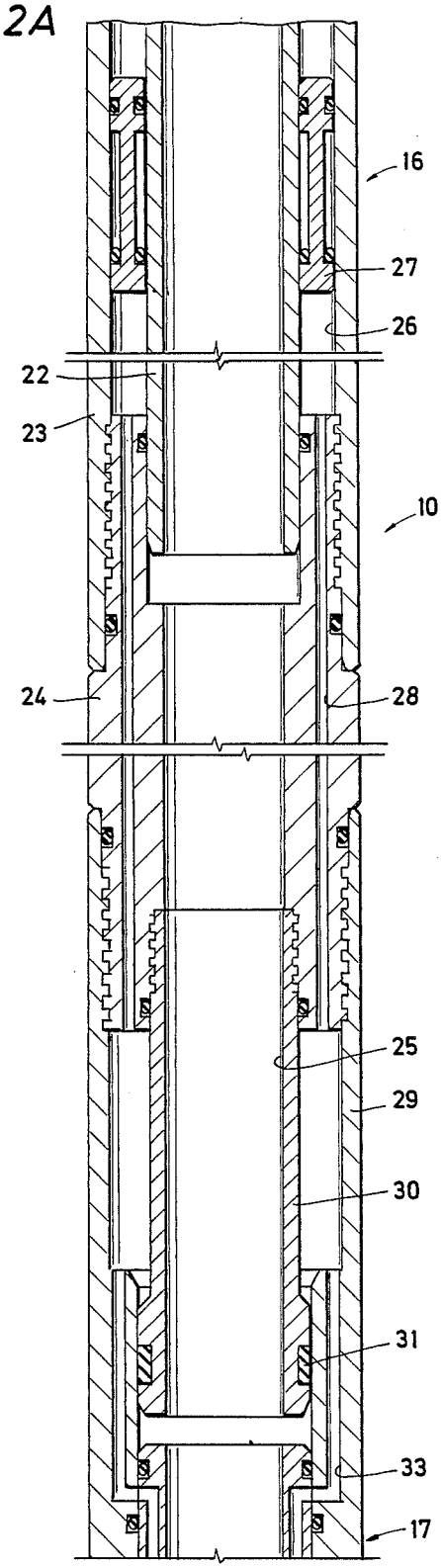
FIGS. 2A–2D are successive, elevational views which are partially cross-sectioned for showing a preferred embodiment of a new and improved full-bore testing tool incorporating the principles of the present invention.

Since the pressure-controlled tester valve 16 which is preferably included in the new and improved testing tool 10 is fully described in the above-identified McGill patent, in FIG. 2A only the lowermost portion of the tester valve is shown. As illustrated, the tester valve 16 has inner and outer coaxially-disposed tubular body members 22 and 23 that are coupled at their lower ends to a tubular end member 24 and arranged for defining a full-bore axial passage 25 through the tester valve. To control the fluid communication through the axial passage 25, the tester valve 16 includes a movable valve member such as a rotatable ball (not seen in the drawings) which is selectively shifted between its open and closed positions by a pressure-responsive actuator (also not seen in the drawings) which is telescopically arranged in a higher portion of the inner body member 22. As described in the McGill patent, the tester valve 16 is cooperatively arranged so that it will be opened by selectively increasing the pressure of the fluids in the well bore 12 to at least a first pressure level and closed whenever the well bore pressure is subsequently reduced below that first pressure level. As described in the McGill patent, closing of the tester valve 16 is facilitated by providing a so-called "reference pressure" chamber in the tool.

Accordingly, in keeping with the McGill patent, the inner and outer body members 22 and 23 are arranged to define an annular chamber 26 above the end member 24 in which an annular piston 27 is slidably and sealingly arranged for dividing the chamber into first and second isolated portions, with the first or upper portion of the chamber being arranged for containing a compressible fluid such as nitrogen or some other suitable gas. A longitudinal passage 28 is arranged in the end member 24 to admit fluids in the well bore 12 into the lower portion of the chamber 26 before the pressure reference tool 17 is operated to block the passage. It will, of course, be appreciated that the upper portion of the piston chamber 26 which is isolated above the annular piston 27 functionally corresponds to the gas or nitrogen chamber seen at "62" in the McGill patent. In addition to isolating a suitable gas confined in the chamber 26 above the piston 27, the piston also serves to increase the pressure of that gas to the pressure level of the well bore fluids which are admitted by way of the longitudinal passage 28 into the lower portion of the chamber before the pressure reference tool 17 has permanently blocked further access to the passage to thereby trap a selected reference pressure in the chamber. The significance of this latter feature will subsequently become more apparent.

Figure 2B:
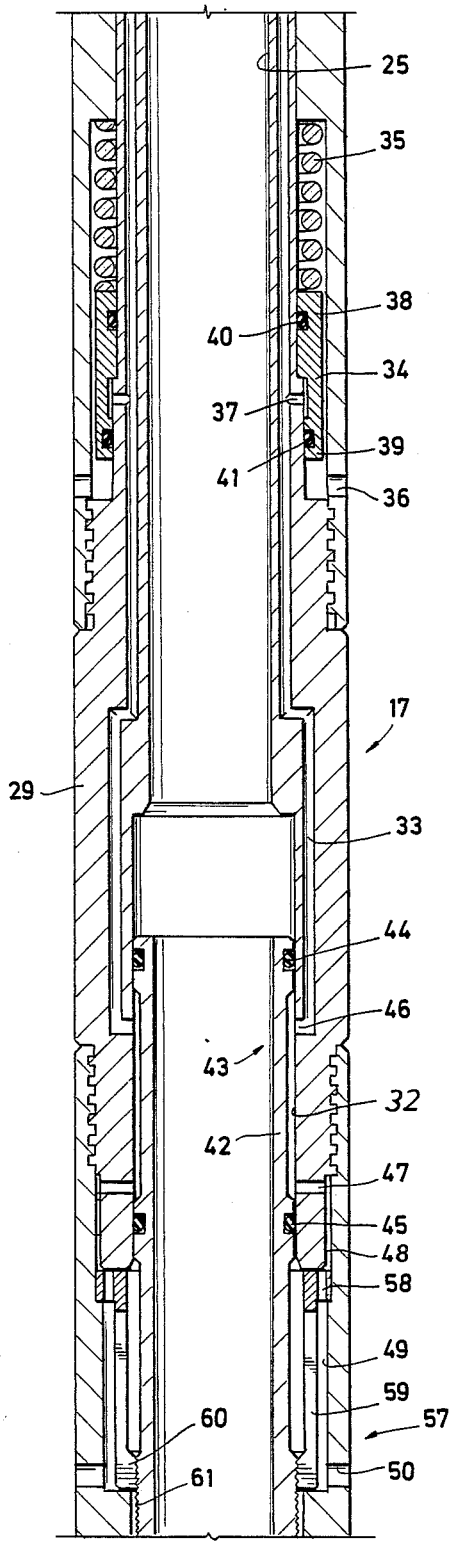
Figure 2C:
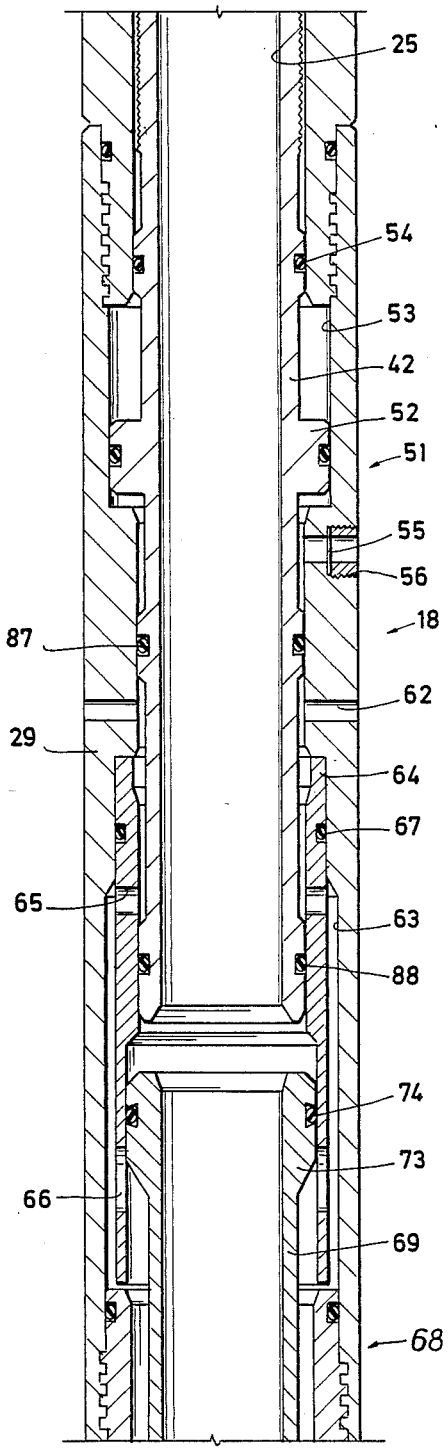
Figure 2D:
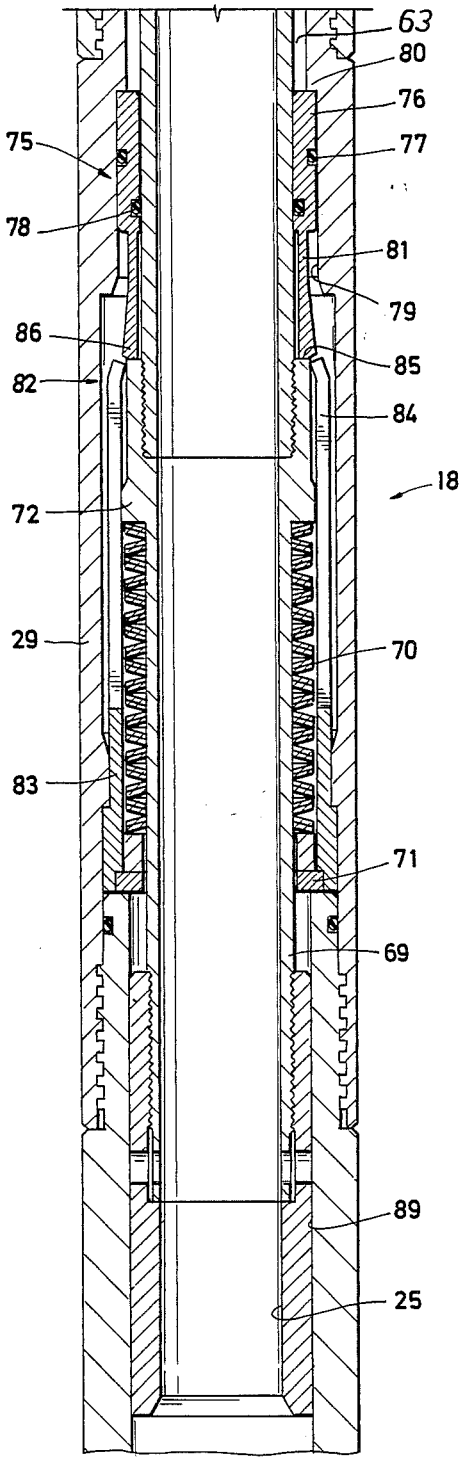

Turning now to FIGS. 2B–2D, a preferred embodiment of the new and improved pressure reference tool 17 and the bypass valve 18 of the invention are depicted as they will respectively appear when the drillstem testing tool 10 is in its initial or so-called "running-in" position. As illustrated, the pressure reference tool 17 and the bypass valve 18 have an elongated body 29 that is preferably arranged as a plurality of tandemly-coupled tubular sections which collectively define a continuation of the axial passage 25 in the tester valve 16 for providing a full-bore passage between the pipe string 11 and the seal assembly 19. To couple the tester valve 16 to the pressure reference tool 17 and the bypass valve 18, as illustrated in FIG. 2A, the end member 24 is threadedly coupled into the upper end of the body 29 and a reduced-diameter tubular extension 30 dependently coupled to the end member is coaxially fitted into and fluidly sealed, as at 31, within the upper end of the tubular body.

To communicate well bore fluids into the lower portion of the chamber 26 in the tester valve 16, as depicted in FIG. 2B, the pressure reference tool 17 has an annular valve chamber 32 and a passage 33 appropriately arranged in the upper portion of the body 29 to be communicated with the longitudinal passage 28 in the lower end member 24 of the tester valve 16 when the two tools are tandemly coupled together. To control the pressure of well bore fluids that will be isolated in the lower portion of the chamber 26 by the operation of the pressure reference tool 17, that tool is also provided with pressure-responsive relief valve means such as an annular valve member 34 and a downwardly-acting biasing spring 35 which are respectively arranged within the valve chamber 32 to control the fluid communication between an external port 36 and an internal port 37 in the body 29 that opens into the passage 33. The valve member 34 has an inwardly-projecting upper portion 38 and a lower skirt portion 39 which respectively carry spaced sealing members 40 and 41 which engage the inner wall of the chamber 32 and are positioned to straddle the internal port 37 and thereby block that port so long as the force of the biasing spring 35 is able to retain the valve member in its illustrated normal port-closing position.

It will, of course, be recognized by those skilled in the art that since there are no external sealing members on the annular valve member 34, the pressure of the fluids in the well bore 12 outside of the tool body 29 will be acting on both ends of the annular valve member 34; and fluids in the longitudinal passage 33 will impose an upwardly-directed pressure force on the lower face of the enlarged upper portion 38 of the valve member which is countered by the downwardly-acting force of the biasing spring 35. Thus, as will be subsequently explained, the valve member 34 will remain in its illustrated port-closing position unless the pressure in the passage 33 exceeds the pressure in the well bore 12 by a predetermined differential which is dependent upon the performance characteristics of the spring 35 and the difference in the cross-sectional areas of the upper and lower portions 38 and 39 of the valve member.

To control the admission of well bore fluids into the lower portion of the chamber 26, the new and improved pressure reference tool 17 of the present invention further includes an elongated valve member or tubular mandrel 42 that, as shown in FIGS. 2B and 2C, is telescopically disposed in the tool body 29 and cooperatively arranged for moving longitudinally between its depicted lower or initial passage-opening position and a higher or final passage-closing position. The pressure reference tool 17 is provided with first or upper valve means 43 including a first pair of sealing members 44 and 45 cooperatively arranged on an upper portion of the mandrel 42 for controlling communication between a first set of longitudinally-spaced ports 46 and 47 in the inner wall of the body 29. In the preferred embodiment of the pressure reference tool 17, the upper port 46 is connected with the passage 33 and the lower port 47 is communicated with the well bore 12 by way of a longitudinal passage 48 leading to an annular space 49 in the body 29 that is, in turn, communicated with the exterior of the tool body by way of a port 50 in the outer wall of the tool body. As illustrated, the sealing members 44 and 45 are appropriately spaced on the mandrel 42 so that the seals will straddle the ports 46 and 47 to intercommunicate them so long as the valve mandrel stays in its initial passage-opening position as well as to locate the lower seal 45 between the ports for blocking communication therebetween one the mandrel has been shifted to its final passage-closing or upper operating position.

In keeping with the objects of the present invention, the pressure reference tool 17 also includes pressure-responsive actuating means 51 selectively operable for shifting the mandrel 42 to its elevated or final operating position only when the well bore pressure is raised to a second level. As seen in FIG. 2C, in the preferred embodiment of the actuating means 51, a piston member 52 is arranged on an intermediate portion of the mandrel 42 and sealingly disposed in an annular chamber 53 in the tool body 29. A sealing member 54 is positioned between the mandrel 42 and the body 29 for isolating the upper portion of the annular chamber 53 above the piston 52. A closure member 55 is sealingly fitted in a port 56 and cooperatively arranged to be selectively opened only in response to an increase of the well bore pressure for admitting fluids from the well bore into the lower portion of the annular chamber 53 below the piston 52. It must be realized, therefore, that so long as the port 56 remains blocked, the lower portion of the annular chamber 53 will stay at a modest pressure such as, for example, atmospheric pressure until the closure member 55 is opened. In the preferred embodiment of the tool 17, it is preferred to arrange the closure member 55 as a so-called "rupture disc" designed to fail in response to a predetermined pressure differential.

To retain the valve mandrel 42 in its lower operating position until the pressure-responsive actuating means 51 have operated to shift the mandrel to its elevated operating position, the pressure reference tool 17 is provided with mandrel-retaining means 57 including a sleeve 58 which, as illustrated in FIG. 2B, is loosely disposed in the annular space 49. The sleeve 58 is longitudinally slotted at circumferentially-spaced intervals for defining a plurality of depending flexible collet fingers 59 cooperatively arranged with inwardly-directed heads 60 on their lower ends that are releasably coupled to the mandrel 42 by means such as complemental internal and external threads 61 which are respectively formed in the heads and around the adjacent portion of the mandrel 42. As depicted in FIGS. 2B and 2C, it will be seen that the threads 61 are cooperatively arranged so that the overall length of the external mandrel threads is at least equal to the longitudinal spacing between the lower and upper operating positions of the mandrel 42 so that the internally-threaded heads 60 on the collet fingers 59 will always be cooperatively engaged with the mandrel threads. The annular space 49 around the collet fingers 59 is appropriately sized for accommodating the outward movement of the collet heads 60 as the collet fingers are being successively flexed inwardly and outwardly by the upward travel of the mandrel 42.

In FIGS. 2C and 2D, a preferred embodiment of the new and improved double-acting bypass valve 18 of the invention is illustrated in its initial or so-called "running-in" position. As depicted, a lateral port 62 is arranged in the tool body 29 a short distance below the port 56 and the interior of the body is cooperatively formed to define an enlarged-diameter annular space 63 just below the port 62. A sleeve 64 is loosely disposed in the annular space 63 to define a fluid passage between the sleeve and the interior wall of the tool body 29 communicating a port 65 in a thick-walled upper portion of the sleeve with one or more circumferentially-spaced ports or elongated slots 66 in a thin-walled lower portion of the sleeve. A seal 67 is arranged around the sleeve 64 above the port 65 to seal the upper portion of the sleeve in relation to the tool body 29.

The bypass valve 18 also includes second valve means 68 comprising a tubular mandrel 69 which is telescopically disposed in the lower portion of the full-bore passage 25 in the tool body 29 and adapted to be moved longitudinally between its illustrated elevated position and one or more lower operating positions. As depicted in FIG. 2D, biasing means such as a coiled spring or a stack of Belleville washers 70 are cooperatively arranged on the mandrel 69 between an upwardly-facing body shoulder 71 and the lower face of a mandrel shoulder 72 to impose a moderate upward force thereon that normally maintains the mandrel in its elevated position. To selectively control fluid communication between the full-bore passage 25 and the well bore above the packer 13, as shown in FIG. 2C the mandrel 69 includes an enlarged upper portion 73 that is slidably disposed within the lower portion of the sleeve 64. A seal 74 is arranged on the enlarged mandrel portion 73 to be located above the ports 66 so long as the mandrel 69 is in its elevated port-closing position and to at least partially uncover the ports 66 when the mandrel is moved downwardly toward one or more of its lower operating positions during the operation of the bypass valve 18.

In keeping with the objects of the present invention, the new and improved double-acting bypass valve 18 also includes pressure-responsive means 75 cooperatively arranged to respond to predetermined changes in the well bore pressure conditions for increasing the overall force required for shifting the mandrel 69 downwardly from its elevated flow-blocking position. As shown in FIG. 2D, in the preferred embodiment of the force-controlling means 75, an annular piston 76 carrying inner and outer seals 77 and 78 is slidably arranged around an intermediate portion of the mandrel 69 and is disposed in an annular chamber 79 in the tool body 29 so that the upper face of the piston is normally engaged against a downwardly-facing shoulder 80 defining the upper end of the chamber. The piston 76 includes a depending skirt portion 81 which will ordinarily be kept in engagement with the upper face of the mandrel shoulder 72 by virtue of the upward force of the biasing springs 70 on the mandrel 69.

In keeping with the objects of the present invention, the force-controlling means 75 also include force-supplementing means 82 cooperatively associated with the piston 76 and adapted for significantly increasing the overall force required to shift the mandrel 69 downwardly from its normal flow-blocking position should there be a predetermined change in the well bore pressure conditions. To accomplish this, the force-supplementing means 82 include a sleeve 83 that is loosely disposed in the space 79 and has an upper portion longitudinally slotted at circumferentially-spaced intervals for defining a plurality of upstanding flexible collet fingers 84 extending upwardly around the mandrel shoulder 72 and terminating adjacent to the upper face of that shoulders. The upper ends of the fingers 84 are shaped to provide inwardly-directed camming surfaces 85 adapted for cooperative engagement by outwardly-directed camming surfaces 86 on the lower end of the depending skirt portion 81. It will, of course, be appreciated that although the opposing end or camming surfaces 85 and 86 are complementally shaped so that downward travel of the piston 76 relative to the collet fingers 84 will expand the fingers as the skirt 81 is driven into the fingers, the piston can not be moved downwardly until the downward force acting on the piston 76 is sufficient to overcome the force resisting the outward expansion of the collet fingers.

Accordingly, as will subsequently be more apparent, the mandrel 69 is normally supported in its elevated flow-blocking position by the moderate force provided by the biasing springs 70. It will, of course, be realized that so long as the opposing end surfaces 85 and 86 are abutted against one another, the valve mandrel 69 is free to move downwardly in relation to the piston 76 and the sleeve 83 against the moderate biasing force developed by the springs 70 as they are compressed between the opposing shoulders 71 and 72. On the other hand, it will be realized that since the skirt portion 81 of the piston 76 can abut on the mandrel shoulder 72, the valve mandrel 69 can also be shifted downwardly in relation to the tool body 29 should the pressure forces imposed on the piston 76 be of such magnitude that the substantial predetermined upward biasing force developed by the force-supplementing means 82 is no longer adequate to maintain the mandrel in its elevated flow-blocking position.

As previously related, the double-acting bypass valve 18 of the present invention is cooperatively arranged to respond to changes in the direction of the pressure differential between the interior and exterior of the bypass valve as will be required to protect the earth formations 14 from adverse pressure changes before the pressure reference tool 17 is initially operated. It will be appreciated, of course, that so long as the mandrel 42 of the pressure reference tool 17 remains in its initial operating position illustrated in FIGS. 2B–2C, sealing members 87 and 88 respectively arranged on the mandrel 42 and incorporated with the second valve means 68 will be straddling the ports 62 and 65. In that initial flow-blocking position of the mandrel 42, the fluids in the well bore 12 above the packer 13 are in communication with the enclosed annular space 63 defined between the sealing member 67 and the upper face of the piston member 76. At the same time, so long as the tester valve 16 has not been opened, the fluids in the full-bore axial passage 25 below the closed tester valve will be communicated through the unsealed annular clearance space 89 (FIG. 2D) around the lower portion of the mandrel 69 into the annular space 79 below the lower face of the piston member 76. Moreover, until such time that the pressure reference tool 17 is initially operated, the fluids in the full-bore axial passage 25 will also simultaneously impose a downward pressure force on the enlarged-diameter upper portion 73 of the mandrel 69 that will be jointly opposed by the moderate upwardly-directed biasing force of the stacked Belleville washers 70 against the mandrel shoulder 72 as well as any upward pressure force imposed against the upper mandrel portion by the well bore fluids in the annular space 63 therebelow.

Accordingly, it will be appreciated that so long as the tester valve 16 remains closed and the pressure reference tool 17 has not yet been operated to permanently block the communication between the ports 62 and 65, the second valve means 68 cooperate to longitudinally position the mandrel 69 of the double-acting bypass valve 18 in accordance with the direction and magnitude of the pressure differential at any given moment between the fluids in the well annulus 12 and the fluids in the full-bore passage 25. For instance, those skilled in the art will recognize that with the tester valve 16 closed, when the seal assembly 19 is first lowered into the seal bore of a previously-installed packer, as at 19, if it were not for unique operation of the double-acting bypass valve 18 of the invention, there would be a substantial increase in the pressure of the fluids in the isolated portion of the well bore 12 below the packer. It will be appreciated that any substantial increase in the pressure of the well bore fluids in the isolated interval below the packer 13 might potentially damage the adjacent earth formations 14.

In keeping with the objects of the present invention, therefore, the new and improved double-acting bypass valve 18 is cooperatively arranged for operating as necessary to prevent the pressure in the isolated zone of the well bore 12 from exceeding a predetermined moderate pressure level that is considered to be sufficiently low to avoid potential damage to the formations 14. Referring again to FIGS. 2C and 2D, it will be recognized that whenever the pressure in the axial passage 25 below the still-closed tester valve 16 is increased above the pressure of the fluids in the well bore 12 outside of the body 29, there will be a corresponding increase in the net pressure forces acting on the mandrel 69 that will begin shifting the valve mandrel downwardly against the moderate biasing force of the springs 70. These increased forces will be effective, therefore, for shifting the mandrel 69 downwardly until the seal 74 begins to pass or uncover the ports 66. Once the ports 66 have been at least partially uncovered, the higher pressure of the fluids within the mandrel 69 will be reduced as these fluids escape into the annular space 63. This reduced pressure will, of course, be effective for correspondingly reducing the downwardly-directed pressure forces on the mandrel 69 so that the biasing springs 70 will shift the mandrel back upwardly toward its normal port-closing position.

It will be appreciated that the mandrel 69 may move upwardly and downwardly several times as the seal assembly 19 is being positioned in the packer 13. Ultimately, however, the pressure differential will again stabilize so that the biasing springs 70 will again retain the valve mandrel 69 in its depicted normal elevated port-closing position. It will, of course, be recalled that the opposing end surfaces 85 and 86 will remain abutted against one another so long as the pressure inside of the mandrel 69 is not reduced below the pressure outside of the tool 18. This will, therefore, leave the mandrel 69 wholly free to move downwardly relative to the piston 76 and the sleeve 83 and be opposed by the moderate biasing force developed by the springs 70 as they are compressed between the opposing shoulders 71 and 72 in addition to the force due to outside pressure.

On the other hand, it will be appreciated that so long as the tester valve 16 remains closed and the pressure reference tool 17 has not yet been operated for permanently blocking the communication between the ports 62 and 65, the second valve means 68 cooperate also to position the mandrel 69 of the double-acting bypass valve 18 as needed to counter a significant decrease in the pressure in the full-bore passage 25. For example, with the tester valve 16 closed, when the seal assembly 19 is positioned in a previously-installed packer, as at 19, if it were not for the new and improved bypass valve 18 there could be substantial decreases in the pressure of the fluids in the isolated portion of the well bore 12 below the packer should it be desired to raise the testing tool 10 to a slightly-higher depth location. It will be recognized that substantial pressure reductions in the isolated interval below the packer 13 can be undesirable.

In keeping with the objects of the present invention, therefore, the new and improved double-acting bypass valve 18 is cooperatively arranged for operating as necessary to prevent the pressure in the isolated zone of the well bore 12 from dropping below a predetermined moderate pressure level that would make it unnecessarily difficult to raise the tool string in the well bore 12. Referring again to FIGS. 2C and 2D, it will be recognized that so long as the pressure reference tool 17 has not yet been initially operated, as the pressure in the full-bore passage 25 begins to fall below the pressure of the well bore fluids outside of the tool body 29, there will be a corresponding increase in the net pressure forces acting upwardly on the mandrel 69 as the hydrostatic pressure of the well bore fluids in the annular space 63 is imposed on the lower face of the enlarged mandrel portion 73. It will be appreciated, however, that the hydrostatic pressure within the annular space 63 is also imposed against the upper face of the piston member 80. Thus, whenever the pressure in the bore 25 and the space 79 becomes lower than the pressure in the space 63, there will be a downward pressure force acting on the piston 76 that will be opposed by the collet fingers 84 acting on the lower end of the skirt 81. It will, of course, be recalled from the previous description of the force-supplementing means 82 that although the opposing end or camming surfaces 85 and 86 are shaped so that the downward travel of the piston 76 relative to the collet fingers 84 will expand the fingers as the skirt 81 is driven into them, the piston can not move downwardly until the downward pressure forces acting on the piston overcome the force resisting the outward expansion of the collet fingers. This can, of course, require a substantial pressure differential which, as will be subsequently described, will be predetermined as needed to assure the reliable operation of the testing tool 10.

At any rate, whenever the differential between the hydrostatic pressure in the chamber 63 and the fluid pressure in the passage 25 reaches this predetermined pressure differential, this pressure differential will be effective for forcibly urging the piston 76 downwardly until the collet fingers 84 are expanded outwardly and the piston skirt 81 can enter the expanded space therebetween. Once the higher level of force is attained, the downward pressure force on the piston member 76 will, of course, be effective for urging the mandrel 69 downwardly until the seal 74 begins to uncover the ports 66. At this time, as the ports 66 are at least partially uncovered, the fluids in the annular space 63 will escape into the axial bore 25. This flow of fluids into the bore 25 will, of course, be effective for correspondingly reducing the downwardly-directed pressure forces on the mandrel shoulder 72 until such time that the force of the biasing springs 70 will shift the mandrel upwardly toward its normal port-closing position. It will be appreciated that once the mandrel 69 is moved upwardly a sufficient distance that the piston skirt 81 is retracted from within the collet fingers 84, it will again be necessary for the pressure in the bore 25 to drop to a level sufficient for driving the piston skirt back under the collet fingers. Nevertheless, the testing tool 10 can be raised to a depth level that can cause the skirt 81 to move into and out of the collet fingers 84 several times as the stinger 19 is being positioned in relation to the packer 13. Finally, however, the pressure differential will again stabilize so that ultimately the biasing springs 70 will again hold the mandrel 69 in its depicted normal elevated port-closing position.

It will, therefore, be realized that the double-acting bypass valve 18 functions to maintain the pressure differential between valve 18 functions to maintain the pressure differential between the well bore 12 and the full-bore passage 25 within a desired range. When, for example, the pressure in the passage 25 becomes excessive, the piston 76 will remain in engagement with the shoulder 80 and the mandrel 69 will be shifted downwardly in relation to the piston 76 until the sealing member 74 is at least partway uncovering the ports 66. Hereagain, when the ports 66 are at least partially uncovered, any excessive pressure in the full-bore axial passage 25 will be relieved as pressured fluids in the passage are discharged into the well bore 12. Conversely, when the pressure in the full-bore passage 25 becomes unduly low, the mandrel 69 will remain in its elevated position until such time that the pressure differential is sufficiently high to drive the skirt 81 into the collet fingers 84. Again, in keeping with the objects of the present invention, it must be kept in mind that the above-described actions of the bypass valve 18 can take place only so long as the pressure reference tool 17 remains in its depicted running-in position where its mandrel 42 is in its illustrated lower position with the seals 87 and 88 straddling the ports 62 and 65 to maintain communication between the well bore fluids and the passage 63. As will be described, once the pressure reference tool 17 is operated, communication between the well bore fluids and the bypass valve 18 will be discontinued for the remainder of the testing operation.

Referring again to FIGS. 2B and 2C, from the previous description of the pressure reference tool 17 it will be recalled that the tool mandrel 42 will remain in its illustrated position until the pressure in the well bore 12 is increased sufficiently to cause the rupture disc 55 to fail and allow the fluids in the well bore to enter the lower portion of the piston chamber 53. From the preceding description of the operation of the bypass valve 18, it will, of course, be appreciated that a substantial increase in the well bore pressure is required to move the piston 76 downwardly. On the other hand, as described in more detail in the above-identified McGill patent, the pressure-operated tester valve 16 is operated by successively increasing and relieving the well bore pressure. Thus, in considering the overall operation of the drillstem testing tool 10, since the pressure reference tool 17 must be operated before opening the tester valve 16 for the first time in a given testing operation, it has been found preferable to design the rupture disc 55 so that it can be opened at a modest pressure differential that is well below the pressure differential required to operate any other tool in the string of tools that might be incorporated with the testing tool and still protect the formations as at 14. By way of example, the rupture disc 55 might be chosen to open in response to a modest pressure differential in the order of 500 or 1000 psi so that the tester valve 16 can be selectively operated by increases of the pressure in the well bore in the magnitude of 1500 to 2000 psig above the normal hydrostatic pressure.

Accordingly, upon consideration of FIGS. 2B and 2C, it will be realized that once the rupture disc 55 is broken, the fluids in the well bore 12 will enter the lower portion of the piston chamber 53 and, as a result, shift the mandrel 42 upwardly to its upper or final operating position. At this time, the seal 88 will be elevated above the port 65 to permanently discontinue fluid communication between the pressure reference tool 17 and the bypass valve 18. It will also be appreciated that once the mandrel 42 is shifted upwardly to its final operating position, the upper valve means 43 will have functioned to block further communication between the well bore 12 and the pressure reference tool 17 once the sealing member 45 moves above the port 47. When that occurs, the well bore fluids that had previously entered the passage 33 by way of the ports 46 and 47 will then be permanently trapped in the passage 33 and will initially be at the well bore pressure that existed at the time that the rupture disc 55 was opened. This so-called "reference pressure" will, therefore, be also trapped in the lower portion of the chamber 26 (FIG. 2A) by way of the intercommunication of the passages 28 and 33.

Hereagain, as fully described in the above-identified McGill patent, this trapped reference pressure will be utilized to facilitate the operation of the tester valve 16. In order to control the level of the reference pressure, the new and improved pressure reference tool 17 is preferably arranged so that the spring 35 in the upper chamber 32 functions to allow the valve member 34 to move upwardly in response to only a modest pressure differential in the order of 200 to 300-psi. This selection of the spring 35 to respond to pressure differentials in that range will allow the nitrogen reference pressure to bleed down to such level as the tools are being withdrawn from the well. The mandrel 42 will be retained in its elevated or final operating position by the pressure of the fluids that entered the lower portion of the piston chamber 53 upon the opening of the rupture disc 55. At this point in the testing operation, the pressure reference tool 17 has also completed its final operation to uniquely establish a predetermined reference pressure in the tester valve 16 and the drillstem operation can then begin as is fully described in the above-identified McGill patent.

It should be particularly recognized that since the new and improved pressure reference tool 17 can not be reopened until the tool is returned to the surface, the well bore fluids will remain trapped in the lower portion of the chamber 26 and the two passages 28 and 33 as well as in that portion of the chamber 32 lying between the seals 40 and 41 on the valve member 34. Thus, whenever a testing operation has concluded and the testing tool 10 is being returned to the surface, the valve member 34 will periodically function as needed to keep the reference pressure in the chamber 26 at a modest increased pressure level above the hydrostatic pressure at any given depth as the tools are being withdrawn from the well bore 12.

Accordingly, it will be appreciated that the new and improved pressure reference tool and bypass valve of the present invention have provided tools which can be incorporated in a tool string including a pressure-controlled tester valve to facilitate the operation of the tester valve without risking damage to the earth formations that are to be tested. In particular, the new and improved tools described herein respectively cooperate for providing a full-bore drillstem testing tool which is capable of being selectively operated from the surface without having to manipulate the supporting pipe string for trapping well bore fluids in an enclosed chamber to provide a source of fluids at an elevated pressure that will enhance the actuation of the tool. Moreover, these new and improved tools cooperatively respond to changes in the pressure differential between the interior and exterior of the pipe string for protecting the earth formations to be tested from adverse pressure changes.

While a particular embodiment of the present invention has been shown and described, it is apparent that changes and modifications can be made without departing from this invention in its broader aspects; and, therefore, the aim in the appended claims is to cover all such changes and modifications as may fall within the true spirit and scope of this invention.

What is claimed is:

1. A well tool adapted to be positioned in a well bore and to conduct fluids produced from an earth formation into a pipe string extending upwardly to the surface, comprising:

a tubular body having an axial flow passage and arranged to be tandemly connected in a pipe string;

tester valve means in said tubular body arranged to open said flow passage in response to an increase of the pressure of the well annulus fluids to a first pressure level above normal hydrostatic;

means for closing said tester valve means in response to a subsequent decrease of the pressure of the well annulus fluids to a value below said first pressure level including a chamber in said tubular body, and floating piston means dividing said chamber into a first portion for containing a compressible fluid and a second portion adapted to be filled by well bore fluids;

reference valve means on said tubular body for controlling the admission of well bore fluids to said second chamber portion including passage means communicating said second chamber portion with the well bore, a valve element movable from a passage-opening first position permitting well annulus fluids to flow through said passage means into said second chamber portion to a second, passage-closing position; and annulus pressure operated means operable upon an increase of the pressure of the well annulus fluids to a predetermined value that is less than said first pressure level to enable said valve element to move to said closed position and thereby trap well bore fluids at a reference pressure in said second chamber portion which is transmitted to said compressible fluid by said floating piston, said annulus pressure operated means including means defining a piston-actuator chamber in said tubular body, normally-closed means for blocking the entrance of well annulus fluids into said piston-actuator chamber and operable only upon an increase of the pressure of the well annulus fluids to said predetermined value for admitting well annulus fluids into said piston-actuator chamber, and a piston arranged in said piston-actuator chamber for moving said valve element to said passage-closing position in response to the pressure of well annulus fluids entering into said piston-actuator chamber.

2. The well tool of claim 1 further including relief valve means in fluid communication with said second chamber portion arranged for reducing the pressure initially trapped therein to lower pressure levels as the tool is being withdrawn from a well.

3. The well tool of claim 1 wherein said first pressure level is greater than said total pressure value.

4. The well tool of claim 1 wherein said normally closed blocking means include a rupture disc which is adapted to open at a selected pressure in excess of atmospheric pressure.

5. The well tool of claim 1 further including check valve means in fluid communication with said second chamber portion arranged for reducing the pressure of well annulus fluids trapped therein to a lower pressure level as the tool is withdrawn from a well.

6. The well tool of claim 1 further including a valve structure cooperatively arranged on said tubular body for controlling the pressure differential between fluids in said axial flow passage below said tester valve element and the well annulus fluids so long as said tester valve element is closed.

7. The well tool of claim 6 wherein said valve structure comprises of:

a valve member arranged for movement in said tubular body between a flow-blocking position preventing fluid communication between said axial flow passage and the well bore and another position providing fluid communication between said axial flow passage and the well bore;

first pressure-responsive valve-actuating means for moving said valve member to its said other position when the pressure in said axial flow passage increases above the well bore pressure;

biasing means normally maintaining said valve member in its flow-blocking position and operable to allow said valve member to be moved to its other position only when a pressure differential of at least a first predetermined magnitude acts on said first valve-actuating means;

second pressure-responsive valve-actuating means operable for moving said valve member to its said other position when the pressure in said axial flow passage decreases below the well bore pressure; and force-supplementing means normally preventing said second valve-actuating means from moving said valve member to its other position and operable for allowing said valve member to be moved to its other position only when a pressure differential of at least a second predetermined magnitude acts on said second valve-actuating means.

8. The well tool of claim 1 further including valve structure means cooperatively arranged on said tubular body for normally blocking fluid communication between said axial flow passage and the well annulus and operable when said tester valve means is closed for opening fluid communication between the well annulus and said axial flow passage when the fluid pressure in said axial flow passage is either lower than the well annulus pressure by at least a first predetermined pressure differential or is greater than the well annulus pressure by at least a second predetermined pressure differential.

9. The well tool of claim 8 wherein the magnitude of said first predetermined pressure differential is greater than the magnitude of said second predetermined pressure differential.

10. The well tool of claim 1, wherein said normally closed means includes a rupture disc for normally blocking the entrance of well annulus fluids into said piston actuator chamber and adapted to open upon an increase of the well annulus pressure to at least said second pressure level for admitting well annulus fluids into said piston actuator chamber, said piston includes a piston actuator arranged in said piston actuator chamber for moving said valve element to said passage-closing position upon admission of well annulus fluids into said piston actuator chamber; and wherein said well tool further includes valve structure means cooperatively arranged for normally blocking fluid communication between said axial flow passage and the well annulus and operable when said tester valve means is closed to provide fluid communication between the well annulus and said axial flow passage when the pressure in said axial flow passage is lower than the well annulus pressure by at least a first predetermined differential as well as when the pressure in said axial flow passage is greater than the well annulus pressure by at least a second predetermined differential.

11. A well tool adapted to be positioned in a well bore and to conduct fluids produced from an earth formation into a pipe string extending upwardly to the surface, comprising:

a tubular body having an axial flow passage and arranged to be tandemly connected in a pipe string;

tester valve means in said tubular body arranged to open said flow passage in response to an increase of the pressure of the well annulus fluids to a first pressure level above normal hydrostatic;

means for closing said tester valve means in response to a subsequent decrease of the pressure of the well annulus fluids to a value below said first pressure level including a chamber in said tubular body, and floating piston means dividing said chamber into a first portion for containing a compressible fluid and a second portion adapted to be filled by well bore fluids;

reference valve means on said tubular body for controlling the admission of well bore fluids to said second chamber portion including passage means communicating said second chamber portion with the well bore, a valve element movable from a passage-opening first position permitting well annulus fluids to flow through said passage means into said second chamber portion to a second, passage-closing position;

annulus pressure operated means operable upon an increase of the pressure of the well annulus fluids to a predetermined value that is less than said first pressure level to enable said valve element to move to said closed position and thereby trap well bore fluids at a reference pressure in said second chamber portion which is transmitted to said compressible fluid by said floating piston, said annulus pressure operated means including, means defining a piston actuator chamber in said tubular body, a rupture disc normally blocking the entrance of well annulus fluids into said piston actuator chamber and adapted to open upon an increase of the well annulus pressure to at least said second pressure level for admitting well annulus fluids into said piston actuator chamber, a piston actuator arranged in said piston actuator chamber for moving said first valve means to said passage-closing position upon admission of well annulus fluids into said piston actuator chamber; and valve structure means cooperatively arranged for normally blocking fluid communication between said axial flow passage and the well annulus and operable when said tester valve means is closed to provide fluid communication between the well annulus and said axial flow passage when the pressure in said axial flow passage is lower than the well annulus pressure by at least a first predetermined differential as well as when the pressure in said axial flow passage is greater than the well annulus pressure by at least a second predetermined differential.

12. The well tool of claim 11 wherein the magnitude of said first predetermined pressure differential is greater than the magnitude of said second predetermined pressure differential.

13. The well tool of claim 11 wherein said valve structure means include:

pressure-responsive valve means arranged for movement between a normal flow-blocking position preventing fluid communication between said axial flow passage and the well annulus and another position allowing fluid communication between said axial flow passage and the well annulus, first means operable for allowing said pressure-responsive valve means to move to said other position when the fluid pressure in said axial flow passage is lower than the well annulus pressure by a first predetermined pressure differential, and second means operable for allowing said pressure-responsive valve means to move to said other position when the fluid pressure in said axial flow passage is greater than the well annulus pressure by a second predetermined pressure differential; and second valve means on said tubular body operable only upon said movement of said first valve means to said final passage-closing position for permanently closing fluid communication between said axial flow passage and the well bore before the initial opening of said tester valve means.

14. A well tool adapted to be lowered in a well bore and coupled to a well packer to conduct connate fluids produced from an isolated earth formation into a pipe string leading up to the surface, comprising:

a tubular body having an axial flow passage and arranged to be tandemly connected in a pipe string;

tester valve means in said body operable for opening said axial flow passage in response to an increase of well bore annulus pressure to a first pressure level above normal hydrostatic;

means for closing said tester valve means in response to a subsequent decrease of the well bore annulus pressure to a value below said first pressure level including means defining a chamber in said body, pressure-transmitting piston means dividing said chamber into a first portion for containing a compressible fluid and a second portion adapted to receive well bore fluids, and resilient means for applying actuating force to said tester valve means to cause closure thereof;

reference valve means on said body for controlling the admission of well annulus fluids into said second chamber portion including a first passage intercommunicating the well annulus and said second chamber portion, said reference valve means including a reference valve element having an initial passage-opening position and being movable to a passage-closing position, an actuator piston chamber, an actuator piston movable in said actuator chamber and operable for moving said reference valve element to its said passage-closing position to trap well annulus fluids under pressure in said second chamber portion, and closure means normally blocking the entrance of well annulus fluids into said actuator chamber and operable to admit well bore fluids into said actuator chamber in response to an increase of the well annulus pressure to a second pressure level that is significantly less than said first pressure level; and relief valve means on said body including a valve member arranged for controlling communication between the well annulus and said axial passage and movable between a normally closed position and an open position, and valve-actuating means operable for moving said relief valve member to its open position for selectively intercommunicating the well bore annulus and said axial flow passage when the fluid pressure in said axial flow passage is lower than the well annulus pressure by at least a first predetermined pressure differential as well as when the fluid pressure in said axial flow passage is greater than the well annulus pressure by at least a second predetermined pressure differential.

15. The well tool of claim 14 wherein said valve-actuating means include a piston operable for moving said relief valve member to said open position when the pressure in said axial flow passage exceeds the well annulus pressure, biasing means normally maintaining said relief valve member in its said closed position and operable when a pressure force of at least a first predetermined magnitude is imposed on said piston for allowing said relief valve member to move to its said open position, a shoulder on said relief valve member, an annular second piston slidably mounted on said relief valve member and adapted to engage said shoulder to move said relief valve member to its said open position when the well annulus pressure communicated through said second passage means exceeds the pressure in said axial flow passage, and yieldable means normally preventing said second piston from moving said relief valve member toward its said open position and operable for allowing said relief valve member to be moved to its said open position only when a pressure force of at least a second predetermined magnitude is imposed on said second piston.

16. The well tool of claim 15 wherein the magnitude of said first predetermined pressure force is less than the magnitude of said second predetermined pressure force.

17. The well tool of claim 15 furhter including pressure regulating check valve means for venting well bore fluids trapped in said second chamber portion as said tool is being withdrawn from a well bore.

18. The well tool of claim 15 wherein said first pressure level is greater than said second pressure level.

19. The well tool of claim 15 wherein said closure means is a rupture disc initially maintaining a compressible medium in said actuator chamber at about atmospheric pressure and being ruptured to admit annulus fluids into chamber in response to an increase of the pressure of the well bore annulus fluids to at least said second pressure level.

20. A well tool adapted to be positioned in a fluid-filled well bore to conduct fluids produced from an earth formation into a pipe string that leads upward to the surface, comprising:

a tubular body defining an axial flow passage and arranged to be tandemly connected in a pipe string;

tester valve means on said body for controlling fluid communication through said flow passage and including means for opening said tester valve means in response to an increase of well bore annulus pressure to at least a first pressure level and for closing said tester valve means upon a decrease of the well bore annulus pressure to a value below said first pressure level, said opening means including a chamber, pressure-transmitting means dividing said chamber into a first chamber portion for containing a compressible fluid and a second chamber portion adapted to receive well bore annulus fluids, said closing means comprising a coil spring that is adapted when compressed to apply closing force; pressure reference valve means including a first passage communicating well annulus fluids with said second chamber portion, a valve element normally open to admit well annulus fluids through said first passage into said second chamber portion, and piston means operable in response to an increase of the well annulus pressure to a second pressure level that is substantially less than said first pressure level for closing said valve element to trap well annulus fluids in said second chamber portion at a pressure that is transmitted to said compressible fluid contained in said first chamber portion by said pressure-transmitting means; and relief valve means on said body for selectively controlling the pressure differential between said flow passage and said annulus when said tester valve means is closed and including a second passage in communication with the exterior of said body, second valve means normally open for admitting well bore fluids into said second passage, means operable in response to closing of said reference valve means for closing said second valve means, first pressure-responsive actuating means operable for moving said relief valve means away from its said passage-closing position when the pressure in said flow passage exceeds the well annulus pressure, biasing means normally maintaining said relief valve member in its said passage-closing position and responsive to a pressure force of a first predetermined magnitude applied to said first actuating means to allow movement of said relief valve member to its said open position, second pressure-responsive actuating means arranged on said relief valve member operable when the pressure in said flow passage is less than the well bore annulus pressure for moving said relief valve member away from its said passage-closing position, and means normally preventing said second actuating means from moving said relief valve member away from its said passage-closing position and responsive to a pressure force of a second predetermined magnitude applied to said second actuating means for moving said relief valve member to its said open position.

21. The well tool of claim 20 further including check valve means for gradually bleeding off well bore fluids trapped in said second chamber portion as said tool is withdrawn from a well.

22. The well tool of claim 20 wherein said first pressure level is greater than said second pressure level.

23. The well tool of claim 20 wherein the magnitude of said first predetermined pressure force is less than the magnitude of said second predetermined pressure force.

24. The well tool of claim 20 wherein said valve element is an elongated, generally cylindrical sleeve having said piston means as an integral part thereof, and selectively operable means for applying annulus pressure to said piston means including a rupture disc initially isolating said piston means from the well annulus fluids and operable to communicate said piston means with the well bore annulus fluids upon an annulus pressure increase to said second pressure level.

25. A well tool for positioning in a well bore to conduct fluids produced from an earth formation into a pipe string comprising:

a tubular body defining an axial flow passage and arranged to be tandemly connected in a pipe string;

normally-closed means on said body initially blocking fluid communication through said axial flow passage and arranged to be opened from the surface to open said axial flow passage;

first bypass valve means on said body including a bypass passage intercommunicating the well bore with said axial passage, a first valve member arranged to control communication between the well bore and said bypass passage and movable from an initial passage-opening position to a final passage-closing position, first valve-actuating means including a chamber in said body, a piston actuator in said chamber and operatively coupled to said first valve member for moving said first valve member to its said final passage-closing position to permanently close said bypass passage upon admission of well bore fluids into said chamber, and closure means normally blocking the admission of well bore fluids into said chamber and selectively opened only in response to an increase of the well bore pressure to at least a predetermined pressure for said first valve-actuating means to move said first valve member to its said final passage-closing position; and second bypass valve means on said body including a second valve member arranged to control communication between said axial passage and said bypass passage and selectively movable between a normal passage-closing position and a passage-opening position for intercommunicating said axial flow passage and said bypass passage, and second valve-actuating means operable for moving said second valve member to its said passage-opening position for selectively intercommunicating the well bore and said axial flow passage when the pressure in said axial flow passage is lower than the well bore pressure by at least a first predetermined pressure differential as well as when the pressure in said axial flow passage is greater than the well bore pressure by at least a second predetermined pressure differential.

26. The well tool of claim 25 wherein the magnitude of said first predetermined pressure differential is greater than the magnitude of said second predetermined pressure differential.

27. The well tool of claim 25 wherein said second valve-actuating means include a first piston cooperatively arranged in said body for moving said second valve member to its said passage-opening position when the pressure in said axial flow passage below said normally-closed means exceeds the well bore pressure, biasing means normally maintaining said second valve member in its said passage-closing position and operable only in response to said first predetermined pressure differential acting on said first piston for allowing said second valve member to move to its said passage-opening position, a shoulder on said second valve member, an annular second piston slidably mounted around said second valve member and cooperatively engaged against said shoulder to move said second valve member toward its said passage-opening position when the well bore pressure communicated through said bypass passage exceeds the pressure in said axial flow passage, and force-supplementing means normally preventing said second piston from moving said second valve member to its said passage-opening position and operable for allowing said second valve member to be moved to its said passage-opening position only in response to said second predetermined pressure differential acting on said second piston.

28. The well tool of claim 25 wherein said closure means normally blocking the admission of well bore fluids into said chamber is a rupture disc initially maintaining a compressible fluid in said chamber at about atmospheric pressure and operable for opening in response to an increase of the pressure of the well bore fluids to at least said predetermined pressure level.

29. A bypass valve for controlling the pressure differential between the interior and exterior of a pipe string positioned in a well bore and comprising:

a tubular body defining an axial flow passage and arranged to be tandemly connected in a pipe string;

first bypass valve means on said body including a bypass passage intercommunicating the well bore with said axial passage, a first valve member for controlling fluid communication between the well bore and said bypass passage and movable from an initial passage-opening position to a final passage-closing position, first valve-actuating means including means defining a chamber, a piston actuator in said chamber operatively coupled to said first valve member to move said first valve member to its said final passage-closing position for permanently closing said bypass passage when well bore fluids are admitted into said chamber, and pressure-responsive closure means normally blocking the admission of well bore fluids into said chamber and selectively opened only in response to an increase of the well bore pressure to at least a predetermined pressure level for said first valve-actuating means to selectively move said first valve member to its said final passage-closing position; and second bypass valve means on said body including a second valve member arranged for controlling fluid communication between said bypass passage and said axial passage and movable between a normal passage-closing position and a passage-opening position for admitting well bore fluids in said bypass passage into said axial flow passage, and second valve-actuating means operable for moving said second valve member to its said passage-opening position for selectively intercommunicating the well bore and said axial flow passage when the fluid pressure in said axial flow passage is lower than the well bore pressure by at least a first predetermined pressure differential as well as when the fluid pressure in said axial flow passage is greater than the well bore pressure by at least a second predetermined pressure differential.

30. The well tool of claim 29 wherein the magnitude of said first predetermined pressure differential is greater than the magnitude of said second predetermined pressure differential.

31. The well tool of claim 29 wherein said closure means normally blocking the admission of well bore fluids into said chamber is a rupture disc initially maintaining a compressible fluid in said chamber at about atmospheric pressure and operable for opening in response to an increase of the pressure of the well bore fluids to at least said predetermined pressure level.

32. The well tool of claim 29 wherein said second valve-actuating means include a first piston cooperatively arranged in said body for moving said second valve member to its said passage-opening position when the pressure in said axial flow passage below said normally-closed means exceeds the well bore pressure, biasing means normally maintaining said second valve member in its said passage-closing position and operable only in response to said first predetermined pressure differential acting on said first piston for allowing said second valve member to move to its said passage-opening position, a shoulder on said second valve member, an annular second piston slidably mounted around said second valve member and cooperatively engaged against said shoulder to move said second valve member toward its said passage-opening position when the well bore pressure communicated through said bypass passage exceeds the pressure in said axial flow passage, and force-supplementing means normally preventing said second piston from moving said second valve member to its said passage-opening position and operable for allowing said second valve member to be moved to its said passage-opening position only in response to said second predetermined pressure differential acting on said second piston.

33. A well tool adapted to be positioned in a well bore and to conduct fluids produced from an earth formation into a pipe string extending upwardly to the surface, comprising:

a tubular body having an axial flow passage and arranged to be tandemly connected in a pipe string;

tester valve means in said tubular body arranged to open said flow passage in response to an increase of the pressure of the well annulus fluids to a first pressure level above normal hydrostatic; means for closing said tester valve means in response to a subsequent decrease of the pressure of the well annulus fluids to a value below said first pressure level including a chamber in said tubular body, and floating piston means dividing said chamber into a first portion for containing a compressible fluid and a second portion adapted to be filled by well bore fluids;

reference valve means on said tubular body for controlling the admission of well bore fluids to said second chamber portion including passage means communicating said second chamber portion with the well bore, a valve element movable from a passage-opening first position permitting well annulus fluids to flow through said passage means into said second chamber portion to a second, passage-closing position;

annulus pressure operated means operable upon an increase of the pressure of the well annulus fluids to a predetermined value that is less than said first pressure level to enable said valve element to move to said closed position and thereby trap well bore fluids at a reference pressure in said second chamber portion which is transmitted to said compressible fluid by said floating piston;

a valve structure cooperatively arranged on said tubular body for controlling the pressure differential between fluids in said axial flow passage below said tester valve element and the well annulus fluids so long as said tester valve element is closed, said valve structure including, a valve member arranged for movement in said tubular body between a flow-blocking position preventing fluid communication between said axial flow passage and the well bore and another position providing fluid communication between said axial flow passage and the well bore, first pressure-responsive valve-actuating means for moving said valve member to its said other position when the pressure in said axial flow passage increases above the well bore pressure, biasing means normally maintaining said valve member in its flow-blocking position and operable to allow said valve member to be moved to its other position only when a pressure differential of at least a first predetermined magnitude acts on said first valve-actuating means, second pressure-responsive valve-actuating means operable for moving said valve member to its said other position when the pressure in said axial flow passage decreases below the well bore pressure, and force-supplementing means normally preventing said second valve-actuating means from moving said valve member to its other position and operable for allowing said valve member to be moved to its other position only when a pressure differential of at least a second predetermined magnitude acts on said second valve-actuating means.

* * * * *